United States Patent [19]

Aoki et al.

[11] Patent Number: 4,994,814

[45] Date of Patent: Feb. 19, 1991

[54] PHASE SHIFT DATA TRANSFER SYSTEM FOR PHASED ARRAY ANTENNA APPARATUSES

[75] Inventors: Toshihiko Aoki; Susumu Hishinuma; Nobutake Orime, all of Kanagawa, Japan

[73] Assignee: Mitsubishi Denki Kabushiki Kaisha, Tokyo, Japan

[21] Appl. No.: 395,443

[22] Filed: Aug. 17, 1989

[30] Foreign Application Priority Data

Aug. 31, 1988 [JP] Japan ..... 63-217076

[51] Int. Cl.[5] ..... H01Q 3/22; H01Q 3/24; H01Q 3/26

[52] U.S. Cl. ..... 342/372

[58] Field of Search ..... 342/372

[56] References Cited

FOREIGN PATENT DOCUMENTS 63-48903 3/1988 Japan .

*Primary Examiner*—Theodore M. Blum

*Attorney, Agent, or Firm*—Wolf, Greenfield & Sacks

[57] ABSTRACT

A phase shift data transfer system for phased array antenna apparatuses having a plurality of antenna elements arranged in rows and columns in an X-Y plane. A phase shifter is connected to each of the antenna elements. In order to form a beam radiating in a desired direction, an amount of phase shift is set in each phase shifter as the sum of a first component and a second component specified by an x coordinate and a y coordinate representative of the location of the antenna element to which the phase shifter is connected. A computing means computes a first component for every x coordinate and a second component for every y coordinate. The first component thus computed is transferred to the phase shifters corresponding to the x coordinate specifying the first component. The second component thus computed is transferred to the phase shifters corresponding to the y coordinate specifying the second component. Each phase shifter adds the first and second components thus transferred and sets the sum in the phase shifter.

21 Claims, 4 Drawing Sheets

PHASE SHIFT DATA TRANSFER SYSTEM FOR PHASED ARRAY ANTENNA APPARATUSES

BACKGROUND OF THE INVENTION

1. Field of the Invention

The present invention relates to a phase shift data transfer system for phased array antenna apparatuses employed in transferring phase shift data to a control circuit for a phase shifter in each of the antenna elements.

2. Description of the Prior Art

FIG. 1 is a schematic representation of the configuration of a plurality of elements of a commonly used phased array antenna apparatus and the direction of a beam formed by this antenna apparatus. A plurality of antenna elements (101), (102), . . . **(10*i*), . . . (10*n*)** are located in the X-Y plane. Each antenna element is provided with a phase shifter having a predetermined phase shift capability so that the phased array antenna apparatus forms a beam in a desired direction. The coordinates of a point on a beam in the desired direction are assumed as $(X_B, Y_B, Z_B)$.

In operation, the phase of a radio wave transmitted or received by each of antenna elements (101) to **(10*n*) is set according to the following equation (1) so that the set of antenna elements (101) to (10*n*)** may transmit or receive a beam of radio waves in a desired direction:

$$\phi_i = k(x_i \cdot X_B + y_i \cdot Y_B) \quad (1)$$

wherein i=1, 2, 3, . . . n (n is the number of antenna elements), k is a constant determined by the radio wave frequency, $\phi_i$ is the phase shift data in the phase shifter in antenna element **(10*i*), and $x_i$ and $y_i$ are the x coordinate and the y coordinate of antenna element (10*i*)**, respectively. Assuming that R is a constant, the following equation (2) is obtained:

$$X_B^2 + Y_B^2 + Z_B^2 = R^2 \quad (2)$$

In order to allow the phased array antenna apparatus to form a beam of radio waves in a desired direction, the amount of phase shift to be set for antenna elements (101), (102), . . . , **(10*n*)** is sequentially computed in accordance with the equation (1). Once the computation of the amount of phase shift to be given to one phase shifter is completed, the result of the computation is transferred as phase shift data to the corresponding phase shifter where such data is held until the next new phase shift data is transferred thereto. The amount of phase shift to be given to another phase shifter is then computed and the result of the computation is also transferred to the corresponding phase shifter in which it is set. Thus, the computation of the amount of phase shift is sequentially conducted for every phase shifter. Once obtained, the result of computation is then transferred to a corresponding phase shifter and set and held there until the next new phase shift data is transferred thereto.

Thus, a predetermined amount of phase shift is set for the phase shifter in every antenna element to allow the phased array antenna apparatus to form a beam of radio waves in a desired direction.

As described above, in the prior art phased array antenna apparatus, phase shift data are sequentially computed in accordance with the equation (1) and transferred to the phase shifters in antenna elements

(101) to **(10*n*)** to be set therein. Therefore, assuming that the time required to compute each phase shift data is Tc and that the time required to transfer each phase shift data to a corresponding phase shifter is Tt, the time (Tall) given by the equation (3) is required to compute and transfer all such phase shift data to all the phase shifters:

$$Tall = n(Tc + Tt) \quad (3)$$

Since the time Tc and the time Tt are constant for each one of antenna elements (101) to **(10*n*)**, the greater the number of antenna elements, the longer the time Tall required to compute the phase shift data and then set a predetermined amount of phase shift in all the phase shifters.

SUMMARY OF THE INVENTION

It is therefore an object of the present invention to provide a phase shift data transfer system for phased array antenna apparatus which can eliminate the above-described disadvantage and in which the time required to compute the phase shift data and then set a predetermined amount of phase shift in all the phase shifters does not increase in proportion to the number of antenna elements.

It is another object of the present invention to provide a phase shift data transfer system for phased array antenna apparatuses wherein the greater the number of antenna elements employed, the lower becomes the total value of the average time required to compute one item of phase shift data and to then set it in a corresponding phase shifter.

The present invention is intended for use in a phase shift data transfer system for phased array antenna apparatuses. In one aspect, the present invention provides a plurality of antenna means arranged in rows and columns in an X-Y plane, each being provided with an amount of phase shift to be given to a transmit/receive signal adapted to enable a beam of radio waves to be transmitted or received in a desired direction, and each serving to radiate the phase shifted signal.

The location of the antenna means in different columns is represented by different x coordinates, and the location of the antenna means in different rows is represented by different y coordinates.

A computing means computes a first component specified by an x coordinate and a second component specified by a y coordinate of an amount of phase shift to be set in each of the antenna means, both components serving to form a beam in a desired direction.

First component data corresponding to the first component computed by the computing means is transferred by a first supply means to the antenna means located in a column having the x coordinate specifying the first component.

Similarly, a second component data corresponding to the second component computed by the computing means is transferred by a second supply means to the antenna means located in a row having the y coordinate specifying the second component.

Each of the antenna means operates to determine the sum of the first and second component data thus supplied so that the amount of phase shift corresponding to the thus determined sum is set in the antenna means.

In an embodiment of the present invention, each of the antenna means comprises an antenna element, a phase shifter connected to the antenna element and a control circuit for setting an amount of phase shift in the phase shifter.

The control circuit comprises an adder circuit for adding the first and second component data thus supplied and outputting the resultant sum, and a first holding circuit for holding a phase shift data corresponding to the sum output from the adder circuit. The phase shift data held in the first holding circuit is set in the phase shifter.

In another aspect, the present invention provides a plurality of antenna elements arranged in rows and columns in an X-Y plane.

The location of the antenna elements in different columns is represented by different x coordinates. The location of the antenna elements in different rows is represented by different y coordinates.

A phase shifting means in which a predetermined amount of phase shift is set to phase shift a transmit/-receive signal is connected to each of the antenna elements.

A computing means computes a first component specified by each of the x coordinates and a second component specified by each of the y coordinates of an amount of phase shift to be set in each of the phase shifters to form a beam in a desired direction.

First component data corresponding to the first component computed by the computing means is supplied by a first supply means to the phase shifting means connected to the antenna elements located in a column having the x coordinate specifying the first component.

Second component data corresponding to the second component computed by the computing means is supplied by a second supply means to the phase shifting means connected to the antenna elements located in a row having the y coordinate specifying the second component.

Each of the phase shifters comprises an adder means for determining the sum of the first and second component data thus supplied. Each of the phase shifting means is provided with a predetermined amount of phase shift corresponding to the thus determined sum.

Specifically, each of the adder means is an adder circuit which outputs the phase shift data. Each of the phase shifting means further comprises a first holding circuit for holding the phase shift data output from the adder circuit and a phase shifter in which the phase shift data held in the first holding circuit is set.

In a further aspect of the present invention, a plurality of antenna elements is provided in a matrix arrangement on an X-Y plane.

The location of the antenna elements in different columns is represented by different x coordinates. The location of the antenna elements in different rows is represented by different y coordinates.

A phase shifting means in which a predetermined amount of phase shift is set to phase shift a transmit/-receive signal is connected to each of the antenna elements.

A computing means computes first component data specified by an x coordinate and second component data specified by a y coordinate of an amount of phase shift to be set in each phase shifting means for forming a beam in a desired direction.

A supply means is provided for supplying the first and second component data computed by the computing means to the corresponding phase shifting means, whereby the first component data computed by the computing means is supplied to the phase shifting means connected to the antenna elements located in a column having the x coordinate specifying the first component and the second component data computed by the computing means is supplied to the phase shifting means connected to the antenna elements located in a row having the y coordinate specifying the second component.

Each of the phase shifting means comprises an adder means for determining the sum of the first and second component data thus supplied. An amount of phase shift corresponding to the thus determined sum is set in each phase shifting means.

In another embodiment of the present invention, the supply means comprises: first data lines for supplying the first component data to the corresponding phase shifting means connected to the antenna elements located in the columns having the x coordinates specifying the first component data; second data lines for supplying the second component data to the corresponding phase shifting means connected to the antenna elements located in the rows having the y coordinates specifying the second component data; and a transfer control circuit for transferring the first and second component data computed by the computing means to the corresponding first and second data lines, respectively. Each of the adder means is an adder circuit. Each of the phase shifting means further comprises a first holding circuit for holding the phase shift data output from the adder circuit and a phase shifter in which the phase shift data held in the first holding circuit is set.

In the above-described various specific embodiments of the present invention, the control circuit and the phase shifting means may comprise either or both of an input/output control circuit which operates to supply the first component data and the second component data from the computing means to the adder circuit as well as to take out the phase shift data held in the first holding circuit, and a second holding circuit for holding correction data adapted to correct the scattering in phase caused by the difference in electrical length of the transmission/reception system for each antenna element.

In the present invention, the first component data representing an amount of phase shift to be set in the phase shifters connected to the antenna elements is commonly transferred to the control circuits for the antenna elements at the location represented by the x coordinate specifying the first component data, and the second component data representing an amount of phase shift to be set in the phase shifters connected to the antenna elements is commonly transferred to the control circuits for the antenna elements at the location represented by the y coordinate specifying the second component. Each of the control circuits determines the sum of the first and second component data transferred thereto and sets an amount of phase shift corresponding to the resultant sum in the phase shifter. Therefore, the frequency of computation and transfer of all the data on the amounts of phase shift equals the sum of the number of columns and rows in which the antenna elements are arranged. Furthermore, the time required to compute the first and second components of one amount of phase shift can be roughly halved as compared to the prior art. Thus, the greater the number of antenna elements arranged in the same coordinates, the shorter becomes the average time required to compute and transfer the phase shift data for one antenna element.

BRIEF DESCRIPTION OF THE DRAWINGS

These and other objects and features of the invention will be readily appreciated by reference to the embodiments shown in the accompanying drawings which are given as mere examples and in which.

DETAILED DESCRIPTION OF THE PREFERRED EMBODIMENTS

Figure 2:
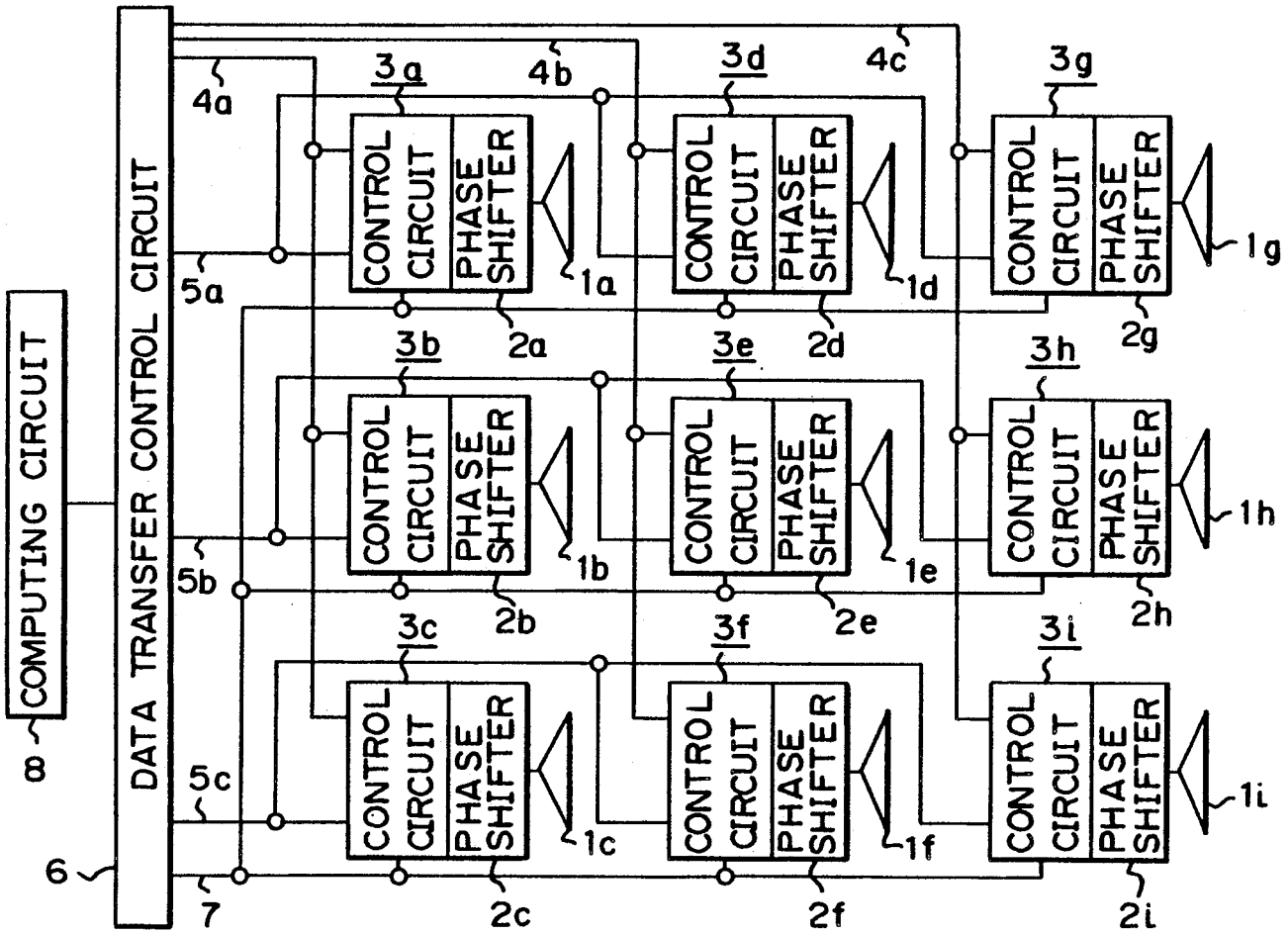
FIG. 2 is a schematic block diagram of the configuration of a phase shift data transfer system for phased array antenna apparatuses of the invention.
Figure 1:
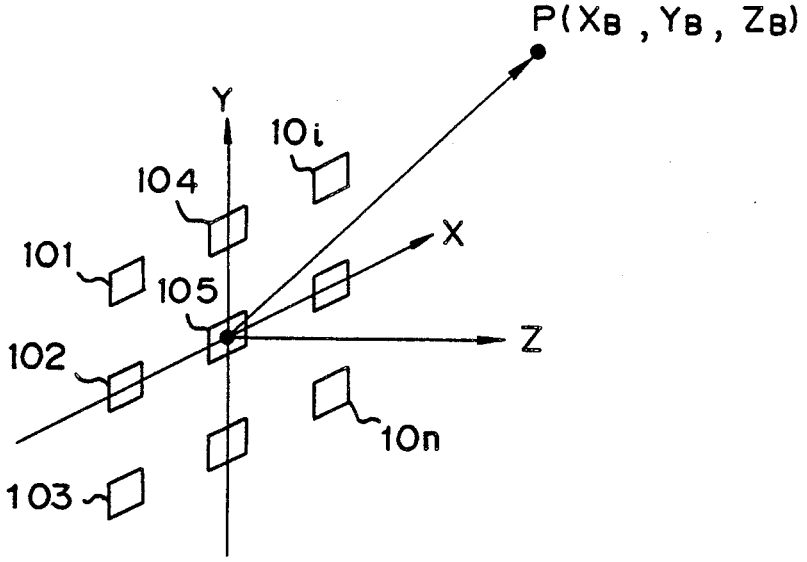
FIG. 1 shows the location of antenna elements of prior art phased array antenna apparatuses in X and Y coordinates.

FIG. 2 is a block diagram illustrating an embodiment of a phase shift data transfer system for phased array antenna apparatuses of the invention. The phased array antenna apparatus in FIG. 2 comprises nine antenna elements 1*a* to 1*i* arranged in matrix in the X-Y plane as shown in FIG. 1. Thus the x coordinate of antenna elements located in the same column are the same, and the y coordinate of antenna elements located in the same row are the same. Hence, the x coordinate of antenna elements 1*a*, 1*b*, 1*c* is $x_{abc}$, the x coordinate of antenna elements 1*d*, 1*e*, 1*f* is $x_{def}$, and the x coordinate of antenna elements 1*g*, 1*h*, 1*i* is $x_{ghi}$. The y coordinate of antenna elements 1*a*, 1*d*, 1*g* is $y_{adg}$, the y coordinate of antenna elements 1*b*, 1*e*, 1*h* is $y_{beh}$, and the y coordinate of antenna elements 1*c*, 1*f*, 1*i* is $y_{cfi}$.

For the purpose of simplifying the explanation, the present embodiment is assumed to employ nine antenna elements. In practice, an extremely large number of antenna elements would be used.

In order to combine the radio waves emitted by antenna elements 1*a* to 1*i* to form a beam of radio waves in a desired direction, phase shifters 2*a* to 2*i* for changing the phase of a transmit/receive radio wave are connected to antenna elements 1*a* to 1*i*, respectively. Phase shifters 2*a* to 2*i* have control circuits 3*a* to 3*i* connected thereto, respectively. Control circuits 3*a* to 3*i* are adapted to control an amount of phase shift to be set in the corresponding phase shifters, i.e., an amount representing the change in phase of radio waves when changed by the corresponding phase shifters.

Controllers 3*a*, 3*b*, 3*c* for phase shifters 2*a*, 2*b*, 2*c* connected to antenna elements 1*a*, 1*b*, 1*c* located at x coordinate $x_{abc}$ are commonly connected to one end of X data line 4*a*; controllers 3*d*, 3*e*, 3*f* for phase shifters 2*d*, 2*e*, 2*f* connected to antenna elements 1*d*, 1*e*, 1*f* located at x coordinate $x_{def}$ are commonly connected to one end of X data line 4*b*; and controllers 3*g*, 3*h*, 3*i* for phase shifters 2*g*, 2*h*, 2*i* connected to antenna elements 1*g*, 1*h*, 1*i* located at x coordinate $x_{ghi}$ are commonly connected to one end of X data line 4*c*. Controllers 3*a*, 3*d*, 3*g* for phase shifters 2*a*, 2*d*, 2*g* connected to antenna elements 1*a*, 1*d*, 1*g* located at y coordinate $y_{adg}$ are commonly connected to one end of Y data line 5*a*; controllers 3*b*, 3*e*, 3*h* for phase shifters 2*b*, 2*e*, 2*h* connected to antenna elements 1*b*, 1*e*, 1*h* located at y coordinate $y_{beh}$ are commonly connected to one end of Y data line 5*b*; and controllers 3*c*, 3*f*, 3*i* for phase shifters 2*c*, 2*f*, 2*i* connected to antenna elements 1*c*, 1*f*, 1*i* located at y coordinate $y_{cfi}$ are commonly connected to one end of Y data line 5*c*.

The other end of X data lines 4*a*, 4*b*, 4*c* and Y date lines 5*a*, 5*b*, 5*c* are connected to a data transfer control circuit 6. These X data lines and Y data lines supply X component data and Y component data, respectively, of phase shift data which determine an amount of phase shift to be set in the phase shifters. Data transfer control circuit 6 controls transfer of X and Y component data of phase shift data, which determine an amount of phase shift to be set in each phase shifter, to one of X data lines 4*a* to 4*c* and to one of Y data lines 5*a* to 5*c*. Furthermore, control circuits 3*a* to 3*i* are commonly connected to data transfer control circuit 6 via clock line 7 which supplies a clock signal for synchronization of the transfer of the X component data and Y component data of the phase shift data which determine amounts of phase shift. Phase shift data computing circuit 8 for computing the X and Y component data of the phase shift data is connected to the input of data transfer control circuit 6.

Phase shifters 2*a* to 2*i* are connected to a transmitter/-receiver (not shown) via transmission means (not shown) such as cables or strip lines.

Figure 3:
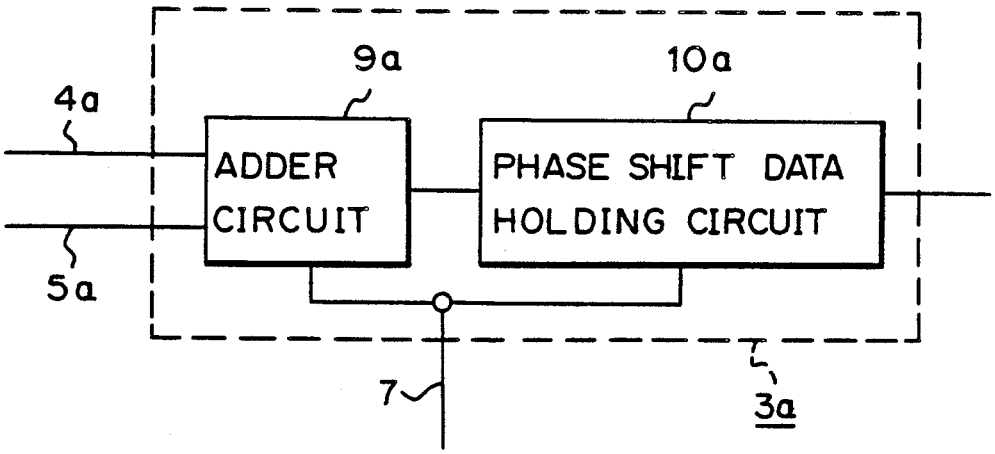
FIG. 3 is a block diagram of the internal configuration of the control circuit shown in FIG. 2.

The nine control circuits 3*a* to 3*i* in FIG. 2 have the same internal configuration, each comprising an adder circuit for adding the X and Y component data supplied from a corresponding one of X data lines 4*a* to 4*c* and a corresponding one of Y data lines 5*a* to 5*c* to produce phase shift data and a phase shift data holding circuit for holding the phase shift data computed by the adder circuit. By way of example, the configuration of control circuit 3*a* is shown in FIG. 3. Control circuit 3*a* comprises an adder circuit 9*a* and a phase shift data holding circuit 10*a*. X data line 4*a* for supplying the X component data and Y data line 5*a* for supplying the Y component data are connected to the input of adder circuit 9*a*. The output of adder circuit 9*a* is connected to the input of phase shift data holding circuit 10*a*, whose output is in turn connected to phase shifter 2*a*. Clock line 7 is connected to adder circuit 9*a* and phase shift data holding circuit 10*a*.

The operation of the phase shift data transfer system for phased array antenna apparatuses thus constructed will next be described. By varying the phase of a transmit/receive radio wave transmitted or received by each antenna element 1*a* to 1*i* in accordance with the equation (4):

$$\phi_n = k \cdot x_n \cdot X_B + k \cdot y_n \cdot Y_B \tag{4}$$

the beam of radio waves transmitted or received by the phased array antenna apparatus comprising antenna elements 1*a* to 1*i* can be directed in a desired direction. The equation (4) is a modification of the equation (1). As described below, the two terms on the right hand side of the equation (4) are assumed to be $\phi_{nX}$ and $\phi_{nY}$, respectively:

$$\phi_{nX} = k \cdot x_n \cdot X_B \tag{5}$$

$$\phi_{nY} = k \cdot y_n \cdot Y_B \tag{6}$$

wherein n equals a, b, . . . , i; $\phi_n$ represents an amount of phase shift of the radio waves transmitted or received by antenna element 1*n*; k is a constant dependent on the operating frequency; and $x_n$ and $y_n$ represent the x coordinate and y coordinate of antenna element 1*n*, respectively. As shown in FIG. 1, $X_B$ and $Y_B$ respectively represent the x coordinate and y coordinate of point P on a beam radiated in a desired direction and have the relationship represented by equation (2) with $Z_B$, which is the z coordinate of point P.

As described above, the x coordinate of antenna elements 1*a*, 1*b*, 1*c* are $x_{abc}$; the x coordinate of antenna elements 1*d*, 1*e*, 1*f* are $x_{def}$; and the x coordinate of antenna elements 1*g*, 1*h*, 1*i* are $x_{ghi}$. The y coordinate of antenna elements 1*a*, 1*d*, 1*g* are $y_{adg}$; the y coordinate of antenna elements 1*b*, 1*e*, 1*h* are $y_{beh}$; and the y coordinate of antenna elements 1*c*, 1*f*, 1*i* are $y_{cfi}$.

In order to form a beam of radio waves in a desired direction, phase shift data computing circuit 8 computes X component data of phase shift data for each of the above x coordinates in accordance with the equation (5) and computes Y component data of the phase shift data for each of the above y coordinates in accordance with the equation (6). The results of these computations are then sent to data transfer control circuit 6.

When the computation of all the X component data and Y component data has been completed, data transfer control circuit 6 transfers these X component data and Y component data to control circuits 3*a* to 3*i* via the corresponding X data lines 4*a* to 4*c* and Y data lines 5*a* to 5*c*, respectively, in synchronism with the clock signal supplied through clock line 7. Specifically, X component data $k \cdot x_{abc} \cdot X_B$ of the phase shift data is supplied to X data line 4*a* and then transferred to control circuits 3*a*, 3*b*, 3*c* in synchronism with the clock signal on clock line 7; X component data $k \cdot x_{def} \cdot X_B$ of the phase shift data is supplied to X data line 4*b* and then transferred to control circuits 3*d*, 3*e*, 3*f* in synchronism with the clock signal on clock line 7; and X component data $k \cdot x_{ghi} \cdot X_B$ of the phase shift data is supplied to X data line 4*c* and then transferred to control circuits 3*g*, 3*h*, 3*i* in synchronism with the clock signal on clock line 7. Likewise, Y component data $k \cdot y_{adg} \cdot Y_B$ of the phase shift data is supplied to Y data line 5*a* and then transferred to control circuits 3*a*, 3*d*, 3*g* in synchronism with the clock signal on clock line 7; Y component data $k \cdot y_{beh} \cdot Y_B$ of the phase shift data is supplied to Y data line 5*b* and then transferred to control circuits 3*b*, 3*e*, 3*h* in synchronism with the clock signal on clock line 7; and Y component data $k \cdot y_{cfi} \cdot Y_B$ of the phase shift data is supplied to Y data line 5*c* and then transferred to control circuits 3*c*, 3*f*, 3*i* in synchronism with the clock signal on clock line 7.

In the respective control circuits 3*a* to 3*i*, adder circuits 9*a* to 9*i* add the X component data and the Y component data of the phase shift data transferred through X data lines 4*a* to 4*c* and Y data lines 5*a* to 5*c* to compute the phase shift data represented by the equation (4), which are then held in phase shift data holding circuits 10*a* to 10*i*, respectively. Thus, phase shift data $k \cdot x_{abc} \cdot X_B + k \cdot y_{adg} \cdot Y_B$ is held in phase shift data holding circuit 10*a* of control circuit 3*a*; phase shift data $k \cdot x_{abc} \cdot X_B + k \cdot y_{beh} \cdot Y_B$ is held in phase shift data holding circuit 10*b* of control circuit 3*b*; phase shift data $k \cdot x_{abc} \cdot X_B + k \cdot y_{cfi} \cdot Y_B$ is held in phase shift data holding circuit 10*c* of control circuit 3*c*; phase shift data $k \cdot x_{def} \cdot X_B + k \cdot y_{adg} \cdot Y_B$ is held in phase shift data holding circuit 10*d* of control circuit 3*d*; phase shift data $k \cdot x_{def} \cdot X_B + k \cdot y_{beh} \cdot Y_B$ is held in phase shift data holding circuit 10*e* of control circuit 3*e*; phase shift data $k \cdot x_{def} \cdot X_B + k \cdot y_{cfi} \cdot Y_B$ is held in phase shift data holding circuit 10*f* of control circuit 3*f*; phase shift data $k \cdot x_{ghi} \cdot X_B + k \cdot y_{adg} \cdot Y_B$ is held in phase shift data holding circuit 10*g* of control circuit 3*g*; phase shift data $k \cdot x_{ghi} \cdot X_B + k \cdot y_{beh} \cdot Y_B$ is held in phase shift data holding circuit 10*h* of control circuit 3*h*; and phase shift data $k \cdot x_{ghi} \cdot X_B + k \cdot y_{cfi} \cdot Y_B$ is held in phase shift data holding circuit 10*i* of control circuit 3*i*. Thus, the phase shift data represented by the equation (4) are held in phase shift data holding circuits 10*a* to 10*i* of control circuits 3*a* to 3*i*, respectively. The phase shift data held in phase shift data holding circuits 10*a* to 10*i* are then set in the corresponding phase shifters 2*a* to 2*i* to vary the phase of radio waves transmitted or received by antenna elements 1*a* to 1*i* in accordance with the predetermined phase shift data.

Thus, with a predetermined amount of phase shift set in each of phase shifters 2*a* to 2*i*, the phased array antenna apparatus comprising antenna elements 1*a* to 1*i* can form a beam of radio waves in a desired direction.

As already described, the prior art phase shift data transfer system for a phased array antenna apparatus comprising nine antenna elements is disadvantageous in that the computation of phase shift data and the transfer of phase shift data must be respectively conducted nine times. In accordance with the present invention, on the other hand, the computation of the equations (5) and (6) need only be conducted three times for each, and the transfer of each item of data need only be conducted six times. Furthermore, since the amount to be computed by equations (5) and (6) is half that computed by equation (1), the time required for computation may be halved again.

In general, when $l \times m$ antenna elements are arranged in l rows and m columns, the sum Tall of the time required for computation and for transfer in the present invention may be roughly represented by the following equation:

$$Tall = (l+m)(Tc/2 + Tt) \tag{7}$$

wherein Tc/2 is the time required to make one computation based on equations (5) and (6), which is half the time Tc [see the equation (3)] required to make one computation in the prior art phase shift data transfer system for a phased array antenna apparatus, and Tt is the time required to transfer X component data or Y component data once for each item of phase shift data.

Therefore, the sum $T_1$ of the average computation time and transfer time per one antenna element can be represented by the following equation (8):

$$T_1 = \frac{l+m}{l \times m} \cdot \left( \frac{Tc}{2} + Tt \right) \tag{8}$$

As can be seen in equation (8), when the number of antenna elements increases, the increase in the denominator is greater than the increase in the numerator. Therefore, the greater the number of antenna elements, the lower becomes the sum $T_1$ of the average computation time and transfer time per one antenna element.

The internal configuration of control circuits 3*a* to 3*i* for phase shifters 2*a* to 2*i* may be of various circuit forms other than what is shown in FIG. 3. The present invention will next be described with reference to control circuit 3*a* by way of example.

Figure 4:
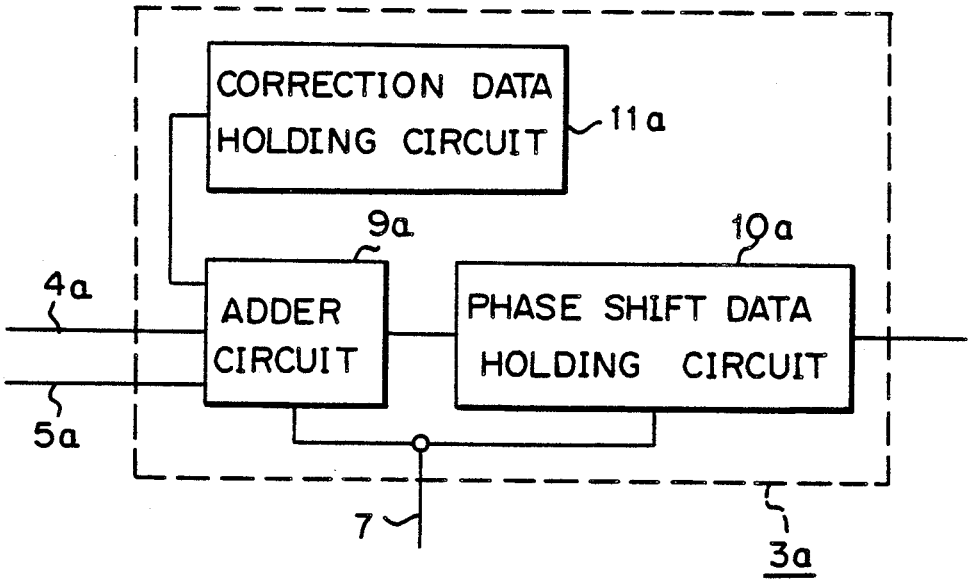
FIGS. 4 through 6 show modified embodiments of the control circuit shown in FIG. 3 wherein FIGS. 4–6 respectively include a correction data holding circuit; an input/output control circuit; and a correction data holding circuit and an input/output control circuit.

FIG. 4 shows an embodiment in which control circuit 3*a* comprises correction data holding circuit 11*a*. In general, the transmission system and the reception system for antenna elements 1*a* to 1*i* exhibit some scattering in electrical length. Data for correcting scattering in phase due to the scattering in electrical length is held as correction data in correction data holding circuit 11*a*. The phase shift data is computed by adding the X component data from X data line 4*a*, the Y component data from Y data line 5*a* and the correction data held in correction data holding circuit 11*a*. Thus, the scattering in phase due to the scattering in the transmission system and reception system for antenna elements 1*a* to 1*i* can be corrected.

Figure 5:
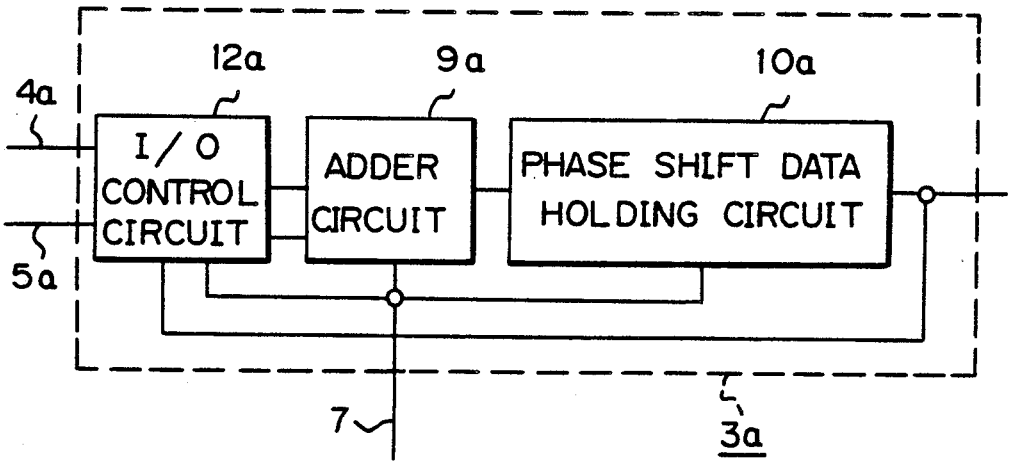

FIG. 5 shows an example in which control circuit 3*a* comprises input/output control circuit 12*a* besides adder circuit 9*a* and phase shift data holding circuit 10*a*. Input/output control circuit 12*a* is adapted not only to input the X component data from X data line 4*a* and the Y component data from Y data line 5*a* to adder circuit 9*a* but also to output the phase shift data held in phase shift data holding circuit 10*a* through either or both of X data line 4*a* and Y data line 5*a* to the outside of control circuit 3*a*. Therefore, when any X component data and Y component data are input to control circuit 3*a*, it is possible to confirm whether the phase shift data obtained by the addition of these data has been output from control circuit 3*a*. Thus, it is possible to check if the function of the control circuit 3*a* is normal or not.

Figure 6:
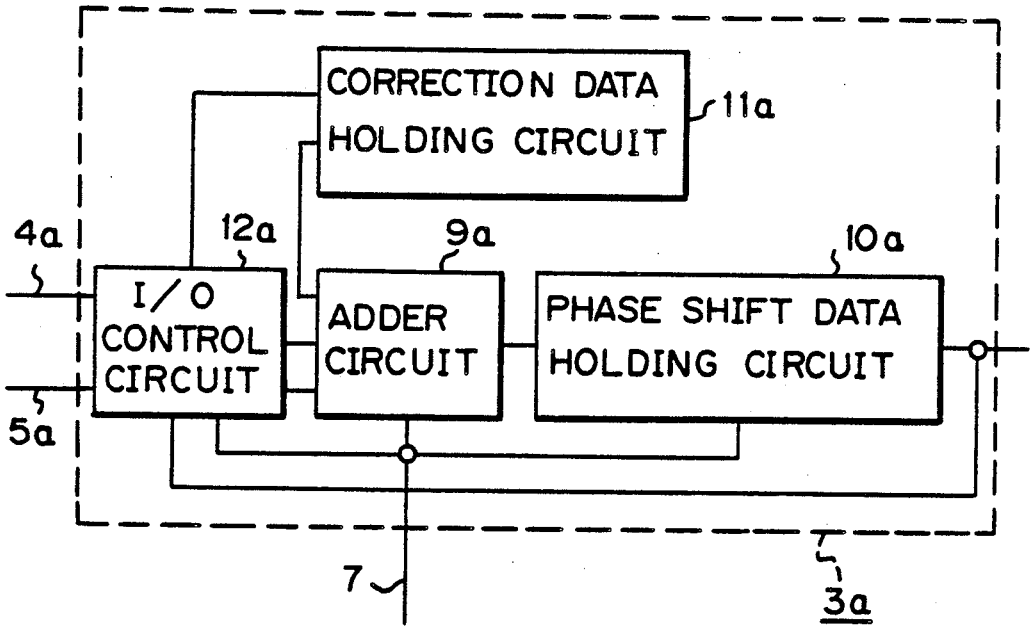

FIG. 6 shows another example in which control circuit 3*a* comprises the above-described correction data holding circuit 11*a* and input/output control circuit 12*a*, besides adder circuit 9*a* and phase shift data holding circuit 10*a*. This example is adapted not only to use the correction data held in correction data holding circuit 11*a* to correct the scattering in phase due to the scattering in electrical length of the transmission system and reception system for antenna element 1*a*, but also to cause input/output control circuit 12*a* to output the correction data held in correction data holding circuit 11*a* through either or both of X data line 4*a* and Y data line 5*a* to the outside of control circuit 3*a*. It is thus possible to confirm if correction data holding circuit 11*a* operates normally or not.

The scattering in electrical length of the transmission system and reception system for the antenna elements are not always constant and usually vary. It is thus desirable to be able to correct the scattering in phase every time the electrical length of the transmission system and reception system shows some variation. To achieve this, the correction data is given an identification sign indicating that data having this sign is correction data. Using this identification sign, input/output control circuit 12*a* can identify if the data input from X data line 4*a* or Y data line 5*a* is the X component data, Y component data or correction data. If the data input is correction data, this data is transferred to correction data holding circuit 11*a* which then holds the correction data thus input in place of the data which has so far been held therein and outputs the new correction data to adder circuit 9*a*. It is therefore possible to hold in correction data holding circuit 11*a* the correction data for correcting any scattering in phase of the radio wave whenever there is any scattering in electrical length of the transmission system and reception system for antenna elements 1*a* to 1*i* or scattering in phase of the radio wave change. Thus, it becomes possible to timely and accurately correct any scattering in phase due to scattering in electrical length of the transmission system and reception system.

While the invention has been described in detail and with reference to specific embodiment thereof, it will be apparent to those skilled in the art that various changes and modifications can be made without departing from the spirit and scope of the invention. For example, while the invention has been described with reference to the case in which antenna elements 1*a* to 1are arranged in the X-Y plane, the same effects can be obtained even if antenna elements 1*a* to 1are arranged in another coordinate plane. In addition, the number of antenna elements is arbitrary; the antenna elements can be arranged in any number of columns and rows. It is not necessary for all the intersections of these columns and rows to be filled with antenna elements; some antenna elements can be thinned out regularly or irregularly.

What is claimed is:

1. Phase shift data transfer system for a phased array antenna apparatus, comprising:

a plurality of antenna means arranged in rows and columns in an X-Y plane, each being provided with a predetermined amount of phase shift to be given to a transmit/receive signal to form a beam in a desired direction, the location of said antenna means in different columns being represented by different x coordinates and the location of said antenna means in different rows being represented by different y coordinates;

a computing means for computing a first component specified by an x coordinate and a second component specified by a y coordinate of an amount of phase shift to be set in each said antenna means to form a beam in a desired direction;

a first supply means for supplying first component data corresponding to said first component computed by said computing means to the antenna means located in a column having the x coordinate specifying said first component; and a second supply means for supplying second component data corresponding to said second component computed by said computing means to the antenna means located in a row having the y coordinate specifying said second component, each said antenna means being operative to determine the sum of the first and second component data supplied so that the amount of phase shift corresponding to said sum is set in each said antenna means.

2. Phase shift data transfer system as set forth in claim 1, wherein each said antenna means comprises an antenna element, a phase shifter connected to said antenna element and a control circuit allowing the amount of phase shift to be set in said phase shifter.

3. Phase shift data transfer system as set forth in claim 2, wherein each said control circuit comprises an adder circuit for adding said first and second component data supplied and for outputting the resultant sum, and a first holding circuit for holding phase shift data corresponding to said resultant sum output from said adder circuit, said phase shift data held in said first holding circuit being set in said phase shifter.

4. Phase shift data transfer system as set forth in claim 3, wherein each said control circuit further comprises a second holding circuit for holding correction data to correct any scattering in phase due to scattering in the electrical length of the transmission and reception systems for each said antenna means, said adder circuit being operative to add said correction data to said phase shift data.

5. Phase shift data transfer system as set forth in claim 3, wherein each said control circuit further comprises an input/output control circuit which operates to supply said first component data and said second component data from said computing means to said adder circuit as well as to take out said phase shift data held in said first holding circuit.

6. Phase shift data transfer system as set forth in claim 3, wherein each said control circuit further comprises an input/output control circuit which operates to supply said first component data and said second component data from said computing means to said adder circuits as well as to take out said phase shift data held in said first holding circuit, and a second holding circuit for holding correction data to correct any scattering in phase due to scattering in the electrical length of the transmission and reception systems for each said antenna means, said adder circuit being operative to add said correction data to said phase shift data.

7. Phase shift data transfer system as set forth in claim 1 wherein said first and second supply means comprises means for simultaneously supplying said first and second component data.

8. Phase shift data transfer system as set forth in claim 1 wherein each of said antenna means comprises a summing means to determine the sum of the first and second component data.

9. Phase shift data transfer system for a phased array antenna apparatus, comprising:

a plurality of antenna elements arranged in rows and columns in an X-Y plane, the location of the antenna elements in different columns being represented by different x coordinates and the location of the antenna elements in different rows being represented by different y coordinates;

a phase shifting means connected to each of said antenna elements, each being given a predetermined amount of phase shift for shifting the phase of a transmit/receive signal;

a computing means for computing a first component specified by an x coordinate and a second component specified by a y coordinate of an amount of phase shift to be set in each said antenna means to form a beam radiating in a desired direction;

a first supply means for supplying first component data corresponding to said first component computed by said computing means to the phase shifting means connected to the antenna means located in a column having the x coordinate specifying said first component; and a second supply means for supplying second component data corresponding to said second component computed by said computing means to the phase shifting means connected to the antenna means located in a row having the y coordinate specifying said second component, each phase shifting means being provided with an adder means for determining the sum of said first component data and said second component data, the amount of phase shift corresponding to said sum being set in each phase shifting means.

10. Phase shift data transfer system as set forth in claim 9, wherein each said adder means is an adder circuit for outputting said phase shift data, and each said phase shifting means further comprises a first holding circuit for holding said phase shift data output from said adder circuit and a phase shifter in which said phase shift data held in said first holding circuit is set.

11. Phase shift data transfer system as set forth in claim 10, wherein each said phase shifting means further comprises a second holding circuit for holding correction data to correct any scattering in phase due to scattering in the electrical length of the transmission and reception systems for each said antenna element, said adder circuit being operative to add said correction data to said phase shift data.

12. Phase shift data transfer system as set forth in claim 10, wherein each said phase shifting means further comprises an input/output control circuit which operates to supply the first component data and the second component data from said computing means to said adder circuit as well as to take out said phase shift data held in said first holding circuit.

13. Phase shift data transfer system as set forth in claim 10, wherein each said phase shifting means further comprises an input/output control circuit which operates to supply the first component data and the second component data from said computing means to said adder circuit as well as to take out said phase shift data held in said first holding circuit, and a second holding circuit for holding correction data to correct any scattering in phase due to scattering in the electrical length of the transmission and reception systems for each said antenna element, said adder circuit being operative to add said correction data to said phase shift data.

14. Phase shift data transfer system as set forth in claim 9 wherein said first and second supply means comprises means for simultaneously supplying said first and second component data.

15. Phase shift data transfer system for a phased array antenna apparatus, comprising:

a plurality of antenna elements arranged in a matrix in an X-Y plane, the location of the antenna elements in different columns being represented by different x coordinates and the location of the antenna elements in different rows being represented by different y coordinates;

a phase shifting means connected to each of said antenna elements, each being given a predetermined amount of phase shift for shifting the phase of a transmit/receive signal;

a computing means for computing first component data specified by an x coordinate and second component data specified by a y coordinate of an amount of phase shift to be set in each said phase shifting means to form a beam radiating in a desired direction; and a supply means for supplying said first and second component data computed by said computing means to the corresponding phase shifting means so as to supply the first component data computed by said computing means to the phase shifting means connected to the antenna elements located in a column having the x coordinate specifying the first component data and to supply the second component data computed by said computing means to the phase shifting means connected to the antenna elements located in a row having the y coordinate specifying the second component data, each said phase shifting means being provided with an adder means for determining the sum of said first component data and said second component data, the amount of phase shift corresponding to said sum being set in each said phase shifting means.

16. Phase shift data transfer system as set forth in claim 15, wherein said supply means comprises:

first data lines for supplying the respective first component data to the corresponding phase shifting means connected to the antenna elements located in the columns having the x coordinates specifying the respective first component data;

second data lines for supplying the respective second component data to the corresponding phase shifting means connected to the antenna elements located in the rows having the y coordinates specifying the respective second component data; and a transfer control circuit for transferring said first and second component data computed by said computing means to the corresponding first and second data lines.

17. Phase shift data transfer system as set forth in claim 16, wherein said adder means is an adder circuit and said phase shifting means further comprises a first holding circuit for holding said phase shift data output from said adder circuit and a phase shifter in which said phase shift data held in said first holding circuit is set.

18. Phase shift data transfer system as set forth in claim 17, wherein each said phase shifting means further comprises a second holding circuit for holding correction data to correct any scattering in phase due to scattering in the electrical length of the transmission and reception systems for each said anenna element, said adder circuit being operative to add said correction data to said phase shift data.

19. Phase shift data transfer system as set forth in claim 17, wherein each said phase shifting means further comprises an input/output control circuit which operates to supply the first component data and the second component data from said computing means to said adder circuit as well as to take out said phase shift data held in said first holding circuit.

20. Phase shift data transfer system as set forth in claim 17, wherein each said phase shifting means further comprises an input/output control circuit which operates to supply the first component data and the second component data from said computing means to said adder circuit as well as to take out said phase shift data held in said first holding circuit and a second holding circuit for holding correction data to correct any scattering in phase due to scattering in the electrical length of the transmission and reception systems for each said antenna element, said adder circuit being operative to add said correction data to said phase shift data.

21. Phase shift data transfer system as set forth in claim 15 wherein said supply means comprises means for simultaneously supplying said first and second component data.

* * * * *